US011105332B2

(12) United States Patent
Huang et al.

(10) Patent No.: US 11,105,332 B2
(45) Date of Patent: Aug. 31, 2021

(54) SCROLL COMPRESSOR HAVING STABLE BACK PRESSURE CHAMBER WITH SEALING MEMBERS

(71) Applicant: Emerson Climate Technologies (Suzhou) Co., Ltd., Jiangsu (CN)

(72) Inventors: Youling Huang, Jiangsu (CN); Chun Yang, Jiangsu (CN); Dang Zeng, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 238 days.

(21) Appl. No.: 15/548,302

(22) PCT Filed: Jan. 29, 2016

(86) PCT No.: PCT/CN2016/072757
§ 371 (c)(1),
(2) Date: Aug. 2, 2017

(87) PCT Pub. No.: WO2016/124111
PCT Pub. Date: Aug. 11, 2016

(65) Prior Publication Data

US 2018/0023570 A1 Jan. 25, 2018

(30) Foreign Application Priority Data

Feb. 4, 2015 (CN) ..... 201510058036.X
Feb. 4, 2015 (CN) ..... 201520079596.9

(51) Int. Cl.
*F04C 27/00* (2006.01)
*F04C 18/02* (2006.01)
(Continued)

(52) U.S. Cl.
CPC ..... *F04C 27/003* (2013.01); *F01C 17/066* (2013.01); *F01C 19/005* (2013.01);
(Continued)

(58) Field of Classification Search
CPC .. F01C 17/066; F01C 19/005; F04C 18/0215; F04C 18/0253; F04C 18/0269; F04C 2240/50; F04C 27/003; F04C 27/005
(Continued)

(56) References Cited

U.S. PATENT DOCUMENTS 4,415,317 A * 11/1983 Butterworth ..... F04C 18/0215 277/379
5,660,539 A * 8/1997 Matsunaga ..... F04C 27/005 184/6.18
(Continued)

FOREIGN PATENT DOCUMENTS

CN 101550933 A 10/2009
CN 102985696 A 3/2013
(Continued)

OTHER PUBLICATIONS

English Machine Translation of CN204692086U published on Oct. 7, 2015, translated on Sep. 3, 2019, Espacenet.*
(Continued)

*Primary Examiner* — Mary Davis
*Assistant Examiner* — Paul W Thiede
(74) *Attorney, Agent, or Firm* — Harness, Dickey & Pierce, P.L.C.

(57) ABSTRACT

A scroll compressor is provided, comprising: a compression mechanism comprising a non-orbiting scroll member and an orbiting scroll member, wherein the orbiting scroll member is axially displaceable between an engagement position and a disengagement position; a main bearing housing adapted to support the compression mechanism; a back pressure chamber formed between the orbiting scroll member and the main bearing housing, wherein the back pressure chamber is in communication with at least one of the compression chambers via a communication passage provided in the
(Continued)

orbiting scroll member or the non-orbiting scroll member and is adapted to apply a back pressure to the orbiting scroll member to bias the orbiting scroll member toward the engagement position; and a first sealing means provided between the back pressure chamber and a suction zone of the compression mechanism and capable of maintaining sealing when the orbiting scroll member is axially displaced.

9 Claims, 9 Drawing Sheets

(51) Int. Cl.
*F01C 19/00* (2006.01)
*F01C 17/06* (2006.01)

(52) U.S. Cl.
CPC ..... *F04C 18/0215* (2013.01); *F04C 18/0253* (2013.01); *F04C 27/005* (2013.01); *F04C 18/0269* (2013.01); *F04C 2240/50* (2013.01)

(58) Field of Classification Search
USPC ..... 418/55.3, 55.4
See application file for complete search history.

(56) References Cited

U.S. PATENT DOCUMENTS 6,086,342 A * 7/2000 Utter ..... F04C 27/005 418/55.5
6,139,295 A * 10/2000 Utter ..... F01C 17/06 418/55.5
8,152,502 B2 4/2012 Nakamura et al.
2004/0042911 A1* 3/2004 Hong ..... F04C 27/005 417/284
2005/0135956 A1* 6/2005 Kimura ..... F04C 29/026 418/55.3
2006/0228244 A1* 10/2006 Goodwin ..... F04C 18/0269 418/55.2
2009/0246059 A1* 10/2009 Nakamura ..... F04C 18/0215 418/55.4
2013/0209305 A1* 8/2013 Takei ..... F04C 18/0215 418/55.3

FOREIGN PATENT DOCUMENTS

CN 204692086 U 10/2015
DE 10341104 B4 2/2011
JP 2000087880 A * 3/2000
JP 2002021752 A 1/2002
JP 2009024663 A 2/2009
JP 2009162083 A 7/2009
JP 2010144522 A 7/2010

OTHER PUBLICATIONS

English Machine Translation of JP2000087880A (translated from Espaceneton Dec. 11, 2019) (Year: 2000).*
International Search Report (in English and Chinese) and Written Opinion (in Chinese) of the International Searching Authority issued in PCT/CN2016/072757, dated May 6, 2016, ISA/CN.

* cited by examiner

*-- Prior Art --*

*-- Prior Art --*

SCROLL COMPRESSOR HAVING STABLE BACK PRESSURE CHAMBER WITH SEALING MEMBERS

This application is the national phase of International Application No. PCT/CN2016/072757, titled "SCROLL COMPRESSOR", filed on Jan. 29, 2016, which claims the benefit of priorities to Chinese Patent Application No. 201510058036.X titled "SCROLL COMPRESSOR", filed with the Chinese State Intellectual Property Office on Feb. 4, 2015, and Chinese Patent Application No. 201520079596.9 titled "SCROLL COMPRESSOR", filed with the Chinese State Intellectual Property Office on Feb. 4, 2015, the entire disclosures of which are incorporated herein by reference.

FIELD OF THE INVENTION

The present application relates to a scroll compressor.

BACKGROUND OF THE INVENTION

The contents of this section only provide background information related to this disclosure, which may not constitute the prior art.

It is known that in a scroll compressor having an axial flexibility, a back pressure chamber is provided on an orbiting scroll member side so as to provide the orbiting scroll member with a back pressure which enables the orbiting scroll member to be axially engaged with a non-orbiting scroll member. However, with this design, in unfavorable operating conditions such as liquid strike, there is a possibility that the back pressure is reduced such that the orbiting scroll member and the non-orbiting scroll member cannot be axially engaged, which causes the compressor to fail to work normally and reduces reliability of operation of the compressor, and further causes a waste of power consumption.

As shown in FIGS. 1 and 2, a scroll compressor (hereinafter also referred to as a compressor) 1 includes a substantially closed housing 10. The housing 10 defines an internal space of the compressor 1. In the example in the drawings, the housing 10 may consist of a generally cylindrical body portion 12, a top cover 14, and a bottom cover 16. These components of the housing 10 may, for example, be connected to each other by any suitable means such as welding, bolting, or the like.

The housing 10 may be provided with a fluid inlet fitting 17 for intake of the working fluid and a fluid outlet fitting 18 for discharging the compressed working fluid. In the housing 10, a compression mechanism CM capable of compressing the fluid may be provided. In the example shown in FIG. 1, the scroll compressor 1 belongs to a high side design. In the art, a compressor in which a drive mechanism is in an exhaust pressure zone (i.e., a high pressure zone) is generally referred to as a high side compressor, and a compressor in which a drive mechanism is in a suction pressure zone (i.e., a low pressure zone) is referred to as a low side compressor.

In the design shown in the drawing, the compression mechanism CM is also in the exhaust pressure zone and the working fluid to be compressed is supplied directly to a suction chamber inside the compression mechanism CM. Specifically, the fluid inlet fitting 17 is hermetically connected with the compression mechanism CM to supply the working fluid to be compressed for the compression mechanism CM.

The drive mechanism 40 for driving the compression mechanism CM may include, for example, a motor composed of a stator 42 and a rotor 43. The stator 42 may be fixed relative to the housing 10 in any suitable manner. The rotor 43 can be rotated in the stator 42 and a drive shaft 45 is provided in the rotor 43. The drive shaft 45 is supported by a main bearing housing 50 and a lower bearing housing 60. An eccentric crank pin 46 is formed at one end of the drive shaft 45. The eccentric crank pin 46 is fit into a hub 32 of an orbiting scroll member 30 via an unloading bushing 48 to drive the orbiting scroll member 30. A lubricating oil passage 47 (only partially shown) is also formed in the drive shaft 45. One end of the lubricating oil passage 47 (i.e., a lower end of the drive shaft 45) is located in a lubricating oil groove formed in a lower side of the housing 10. At said one end of the lubricating oil passage 47, an oil pumping device 49 may be provided.

In this example, the drive mechanism 40 is provided in the housing 10. It is to be appreciated by the person skilled in the art that the drive mechanism 40 may also be provided at the outside of the housing 10 for a so-called open compressor design.

In the example shown in the drawings, the compression mechanism CM may include a non-orbiting scroll member 20 and the orbiting scroll member 30. The non-orbiting scroll member 20 may be fixed relative to the housing 10 in any suitable manner, for example, fixed by bolts relative to the main bearing housing 50 described later.

FIG. 2 shows a detail view of a compression mechanism CM in the conventional technology. A communication passage 35 in FIG. 1 is not shown in FIG. 2 due to the cutting position. As shown in FIG. 2, the non-orbiting scroll member 20 may include a non-orbiting scroll member end plate 24, non-orbiting scroll member vanes 26 formed on one side of the non-orbiting scroll member end plate 24, and a peripheral wall portion 22 located on a radially outermost side of the non-orbiting scroll member 20. The peripheral wall portion 22 may constitute a part of the non-orbiting scroll member vanes 26. An exhaust port 28 is formed at a substantially central portion of the non-orbiting scroll member end plate 24. The orbiting scroll member 30 may include an orbiting scroll member end plate 34, orbiting scroll member vanes 36 formed on one side of the orbiting scroll member end plate 34, and a hub 32 formed on the other side of the orbiting scroll member end plate 34. In the example illustrated, each of the vanes of the non-orbiting scroll member 20 and the orbiting scroll member 30 is designed to form a single scroll. The main bearing housing 50 adapted to support the compression mechanism CM may be fixed relative to the housing 10 by any suitable manner. The orbiting scroll member 30 can be driven by the drive mechanism 40 to make translational revolution with respect to the non-orbiting scroll member 20 (i.e., the center axis of the orbiting scroll member 30 rotates around the central axis of the non-orbiting scroll member 20 at a radius of revolution Ror_1, and the orbiting scroll member 30 itself does not rotate about its own central axis) to achieve fluid compression. The translational revolution is realized by an Oldham coupling 58 provided between the non-orbiting scroll member 20 and the orbiting scroll member 30.

The non-orbiting scroll member vanes 26 may be engaged with the orbiting scroll member vanes 36 to form, together with the non-orbiting scroll member end plate 24 and the orbiting scroll member end plate 34, a series of compression chambers C1, C2, C3 . . . whose volumes are reduced gradually from a radially outer side to a radially inner side to compress the fluid. Thus, the radially outermost compression chamber C1 is referred to as a low pressure chamber or a suction chamber, the intermediate compression chamber C2 is referred to as an intermediate pressure chamber, and the radially innermost compression chamber C3 is referred to as a high pressure chamber or a discharge chamber. The exhaust port 28 may be in fluid communication with the high pressure chamber C3. It should be appreciated that the reference to the low pressure chamber, the intermediate pressure chamber and the high pressure chamber is merely used for convenience of description, and in a practical compressor, the pressures inside these compression chambers are gradually increased and the number of the compression chambers is not limited to three.

In the normal operation of the compressor 1, the non-orbiting scroll member 20 and the orbiting scroll member 30 shall be radially engaged with each other to compress the working fluid. In addition, in order to provide a certain degree of axial flexibility to the scroll set to increase the reliability and safety of the compressor, a back pressure chamber is generally provided between the orbiting scroll member 30 and the main bearing housing. The back pressure chamber B is in communication with a compression chamber (for example, the intermediate pressure chamber C2) via the communication passage 35 (referring to FIG. 1) formed in the orbiting scroll member 30 (e.g., the orbiting scroll member end plate 34), thereby accumulating a back pressure in the back pressure chamber B, so as to enable the non-orbiting scroll member 20 and the orbiting scroll member 30 to be reliably engaged with each other under the action of the back pressure. It should be appreciated that the communication passage may also be formed in the non-orbiting scroll member 20 as long as it introduces pressure in the compression chamber into the back pressure chamber.

In the compressor design shown in FIGS. 1 and 2, the back pressure chamber B is provided at the orbiting scroll member 30 side and located in a space inside the main bearing housing 50, and the back pressure chamber B is defined by the main bearing housing 50 together with the non-orbiting scroll member 20 and the orbiting scroll member 30.

Referring to FIG. 2, a part of the peripheral wall portion 22 of the non-orbiting scroll member 20 is hermetically engaged with a first part 52 of the main bearing housing 50, for example, the both are hermetically engaged by a gasket provided therebetween and bolts connected therebetween, to isolate the back pressure chamber B from an external pressure (in the high side design, the external pressure is a high pressure). Since both the non-orbiting scroll member 20 and the main bearing housing 50 are fixed members, the sealed engagement between the both is easy to achieve. A sealing surface, associated with the orbiting scroll member 30, of the back pressure chamber B is discussed below with particular emphasis.

Since the compression mechanism CM and the drive mechanism 40 are both in the high pressure side overall, a high pressure is also present in the hub 32 of the orbiting scroll member 30. As a result, during the normal operation of the compressor, the resultant force of the back pressure in the back pressure chamber B and the pressure in the hub 32 is greater than the resultant force of the pressures of the working fluid in the compression chambers C1, C2 and C3, whereby enabling the orbiting scroll member 30 and the non-orbiting scroll member 20 to be axially engaged with each other at a seal portions Sc, and the orbiting scroll member 30 to be in an engaged position.

When the compressor is in operation conditions such as liquid strike, for example, the resultant force (in a downward direction in the drawing) of pressures of the working fluid in the compression chambers C1, C2 and C3 will be greater than the resultant force (in an upward direction in the drawing) of the back pressure in the back pressure chamber B and the pressure in the hub 32, whereby the orbiting scroll member 30 and the non-orbiting scroll member 20 are axially separated from each other by a predetermined distance (also referred to as a floating amount) at the seal portions Sc, thus enabling the compression chambers to be communicated and depressurized, and thereby protecting the compression mechanism from being damaged.

However, when the compression mechanism needs to be re-engaged in the above-described case, the orbiting scroll member 30 and the non-orbiting scroll member 20 are in a separated state, and at this time, the seal portions Sc cannot isolate the suction chamber C1 from the back pressure chamber B, such that it is difficult to establish a back pressure in the back pressure chamber B, and it is difficult for the scroll set to achieve normal compression. In addition, in the operation of the compressor, since the pressures in the compression chambers change or fluctuate, overturning of the scroll set or one scroll member may probably occur. In this case, this also causes that the seal in the seal portions Sc may be failed, and the intermediate pressure chamber C2 and the low pressure chamber C1 are in communication with each other, thus resulting in a decrease of pressure in the intermediate pressure chamber C1, and the separation of the orbiting scroll member 30 from the non-orbiting scroll member 20, and a reduced mechanical performance of the compressor. Moreover, when the orbiting scroll member 30 is overturned, the wear between the orbiting scroll member 30 and the non-orbiting scroll member 20 may adversely affect the seal portions Sc and reduce the reliability of the compressor.

Therefore, in the conventional technology, in order to reduce the leakage at the seal portions Sc, it is necessary to design the floating amount of the orbiting scroll member to be small so as to make it possible to set a back pressure as soon as possible at the time of starting and to prevent the scroll member from being significantly overturned. However, with the design of a small amount of floating, many other issues may be encountered. For example, when abnormal operating conditions such as liquid strike are encountered, a small floating amount may cause an insufficient degree of separation of the orbiting scroll member 30 from the non-orbiting scroll member 20, that is, a full depressurization cannot be achieved. In addition, since the temperature in the compression mechanism CM changes, the orbiting scroll member 30 and the non-orbiting scroll member 20 may be slightly deformed. When the floating amount is small, the deformed orbiting scroll member 30 is apt to be stuck with the deformed non-orbiting scroll member 20 after being overturned, and thus it is not easy to return to normal engagement. In addition, the small floating amount requires a high processing accuracy of each of relevant parts, which adds the manufacturing difficulty and cost.

Therefore, there is a need for a scroll compressor which is further improved in reliability.

SUMMARY OF THE INVENTION

One object of one or more embodiments of the present application is to provide a scroll compressor which is further improved in reliability.

In order to achieve the above object, according to one aspect of the present application, a scroll compressor is provided, which includes: a compression mechanism, a main bearing housing, a back pressure chamber and a first sealing means. The compression mechanism includes a non-orbiting scroll member and an orbiting scroll member. The orbiting scroll member is axially movable between an engagement position and a disengagement position. In the engagement position, the orbiting scroll member and the non-orbiting scroll member are axially engaged with each other to form a series of compression chambers for compressing fluid, and in the disengagement position, the orbiting scroll member is axially separated from the non-orbiting scroll member. The main bearing housing is adapted to support the compression mechanism. The back pressure chamber is formed between the orbiting scroll member and the main bearing housing. The back pressure chamber is in communication with at least one compression chamber via a communication passage provided in the orbiting scroll member or the non-orbiting scroll member, and is adapted to apply a back pressure to the orbiting scroll member to bias the orbiting scroll member toward the engagement position. The first sealing means is provided between the back pressure chamber and a suction zone of the compression mechanism, and is capable of maintaining sealing when the orbiting scroll member is axially displaced.

In such a scroll compressor, the compression chamber in the compression mechanism is always kept isolated from the back pressure chamber by the first sealing means. When the compressor is cold-started, it is possible to quickly generate pressure in the back pressure chamber, to allow the orbiting scroll member and the non-orbiting scroll member to be quickly engaged, which facilitates speeding up the starting speed of the compressor. When the compressor is unloaded, the compression chambers in the compression mechanism are communicated and the pressure is released to the suction pressure. In this case, the pressure in the back pressure chamber is not released, thus, when the compression mechanism needs to be engaged again, the pressure in the back pressure chamber enables the orbiting scroll member to rapidly move toward the non-orbiting scroll member and an axial seal is formed, thereby facilitating improving the efficiency of the compressor and reducing the power consumption.

Optionally, the first sealing means is arranged in a first circumferential groove located in one of the orbiting scroll member and the non-orbiting scroll member and abuts against the other of the orbiting scroll member and the non-orbiting scroll member. Alternatively, the first sealing means is arranged in a first circumferential groove located in one of the orbiting scroll member and the main bearing housing and abuts against the other of the orbiting scroll member and the main bearing housing.

In such a scroll compressor, the position of the first sealing means can be flexibly arranged.

Optionally, the first sealing means includes a first sealing member arranged in the first circumferential groove and a first elastic element located between the first sealing member and the first circumferential groove, and the first elastic element applies a biasing force to the first sealing member.

In such a scroll compressor, it is possible to ensure that the first sealing means maintains sealing when the orbiting scroll member is moved.

Optionally, the first sealing means includes a first passage and a first sealing member arranged in the first circumferential groove. The first passage introduces a pressure higher than a suction pressure of the compression mechanism into the first circumferential groove to apply a biasing force to a bottom surface of the first sealing member.

Optionally, the scroll compressor is a high side compressor, and the first passage introduces the pressure in the back pressure zone or the pressure in an external environment of the compression mechanism into the first circumferential groove. Alternatively, the scroll compressor is a low side compressor, and the first passage introduces the pressure in the back pressure zone into the first circumferential groove.

By using machining instead of elastic elements, it is possible to reduce the number of parts and save costs.

Optionally, the first sealing means includes a first sealing member embedded in the first circumferential groove, and the first sealing member has a radial dimension less than a radial dimension of the first circumferential groove.

By using a simple sealing member, it is possible to reduce the number of parts and save costs.

Optionally, the scroll compressor further includes a second sealing means. The second sealing means is arranged in a second circumferential groove located in one of an axial end face of a hub of the orbiting scroll member and the main bearing housing and abuts against the other of the axial end face and the main bearing housing. The second sealing means is capable of maintaining sealing when the orbiting scroll member is axially displaced.

In a case that the scroll compressor is a low side scroll compressor, arranging the second sealing means between the axial end face of the hub of the orbiting scroll member and the main bearing housing enables the positions of the first sealing means, the second sealing means and the Oldham coupling to be offset in the axial direction, and enables the Oldham coupling to have a larger space for adjustment. In addition, the second sealing means can be made smaller, which facilitates expanding the back pressure chamber area, optimizing the axial force and improving the compressor performance.

Optionally, the second sealing means includes a second sealing member arranged in the second circumferential groove and a second elastic element located between the second sealing member and the second circumferential groove, and the second elastic element applies a biasing force to the second sealing member.

Optionally, scroll vanes of the orbiting scroll member and the non-orbiting scroll member are in the form of a twin scroll.

By using the form of the twin scroll, it is possible to increase the adjustment range of the sealing member and to facilitate the design of the force applying area of the back pressure zone, thereby further optimizing the axial force of the scroll set and improving adaptability for the occasion of a relatively compact structure.

BRIEF DESCRIPTION OF THE DRAWINGS

The features and advantages of one or more embodiments of the present application will become more readily understood from the following description with reference to the accompanying drawings in which:

FIGS. 3B and 3C show an enlarged view of a portion P1 in FIG. 3A, wherein FIG. 3B shows a state in which an orbiting scroll member is engaged with a non-orbiting scroll member, and FIG. 3C shows a state in which the orbiting scroll member is disengaged from the non-orbiting scroll member;

DETAILED DESCRIPTION

Figure 1:
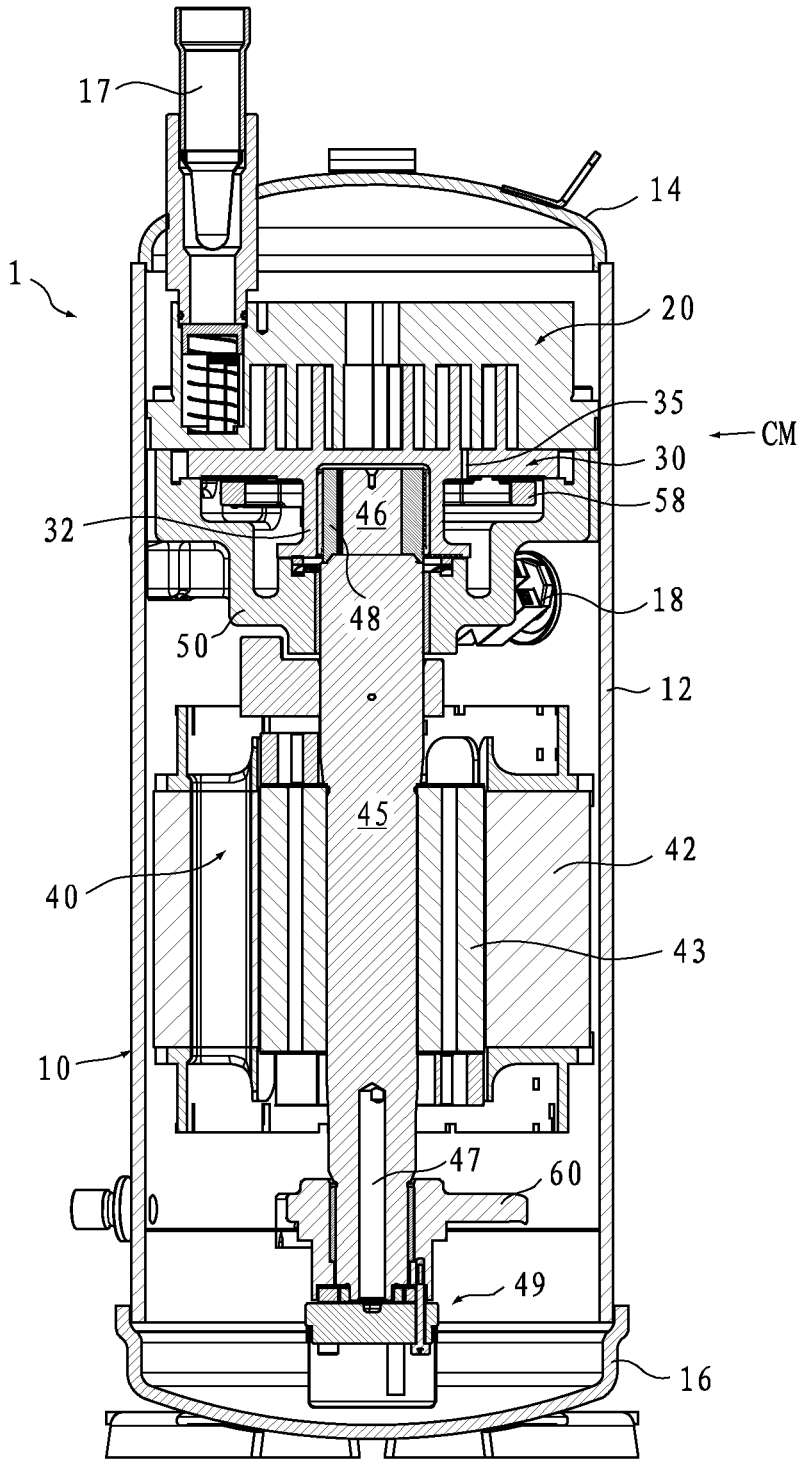
FIG. 1 shows an axial sectional view of a scroll compressor to which the present application can be applied.

The following description of the preferred embodiments is merely exemplary and is by no means intended to limit the present application and its application or usage. The like reference numerals are used to designate like parts throughout the drawings, and the description of the construction of the like parts will not be repeated.

The basic construction and operation principle of the scroll compressor 1 to which the present application can be applied has been described above with reference to FIG. 1.

Figure 2:
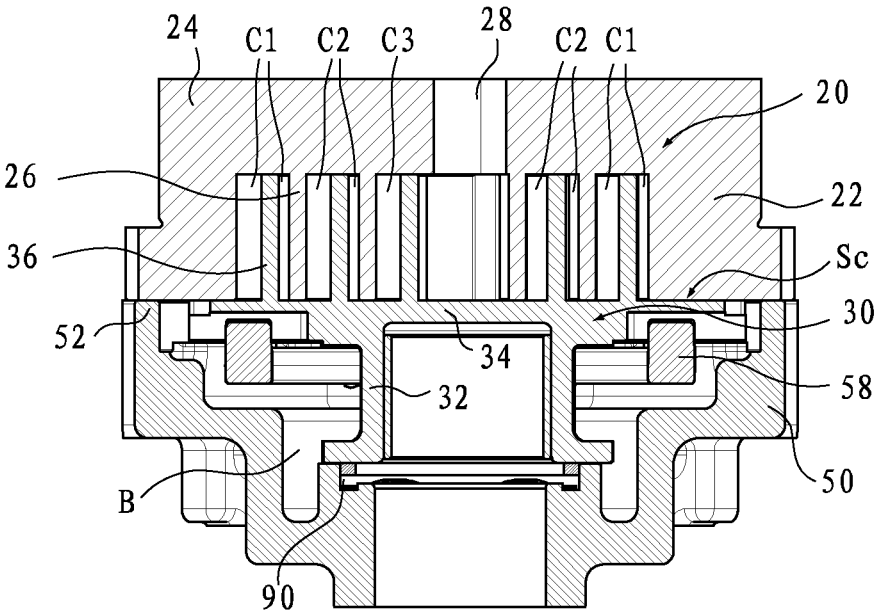
FIG. 2 shows a partial sectional view of a scroll compressor in the conventional technology.

The inventors have inventively found that in this scroll compressor shown in FIGS. 1 and 2, the seal portions Sc provide double sealing effects, that is, providing a sealing surface for the formation of the compression chamber, and isolating the back pressure chamber B from the compression chamber. Such seal portions Sc are the most common arrangement of the conventional floating orbiting scroll compressors so that many technicians are unaware that it actually has the double sealing effect. However, this functional coupling causes that the compression chamber cannot be depressurized without affecting the back pressure chamber B. The inventors have realized that the above issue can be satisfactorily addressed if the seal portions forming the compression chamber are separated from the seal portions for isolating the back pressure chamber B from the compression chamber.

Specifically, it is assumed that only the function of sealing the compression chamber (i.e., as the compression chamber seal portions Sc) of the seal portions Sc is retained and the function of isolating the back pressure chamber B from the compression chamber of the seal portions Sc is deleted, and an additional first sealing means 180 is used to isolate the back pressure chamber B from the compression chamber.

An improvement of the high side scroll compressor according to a first embodiment of the present application in views of sealing of the back pressure chamber will be described below with reference to FIGS. 3A to 3D. Only portions of the scroll compressor according to the first embodiment different from those of the scroll compressor 1 are shown in the drawings, and the same elements as those of the scroll compressor 1 are denoted by the same reference numerals and are not described in detail. The components of the scroll compressor according to the first embodiment different from those of the scroll compressor 1 are described below, they are denoted by corresponding reference numerals beginning with 1 respectively.

Figure 3A:
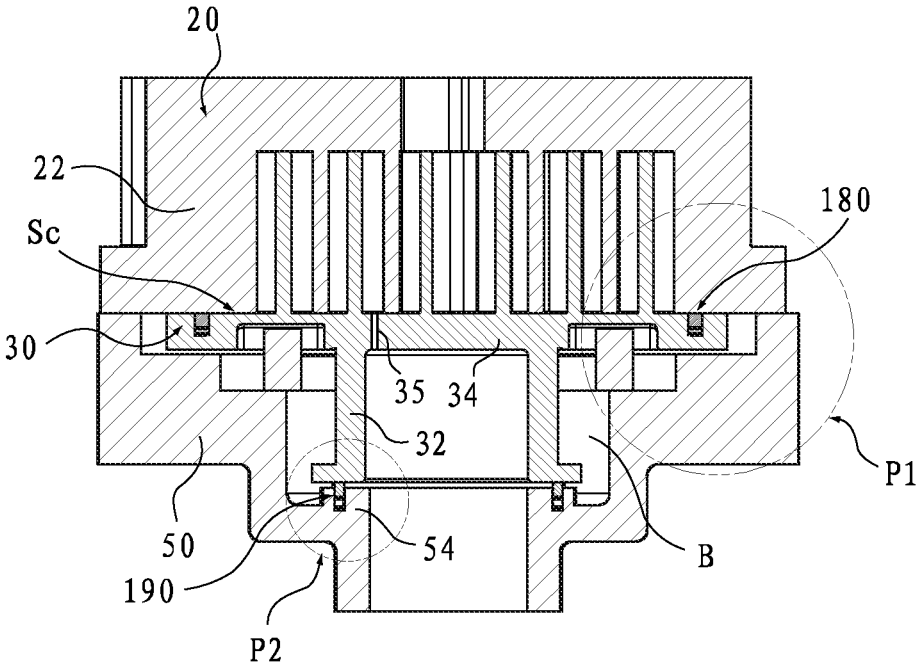
FIG. 3A shows a partial sectional view of a scroll compressor according to a first embodiment of the present application.
Figure 3B:
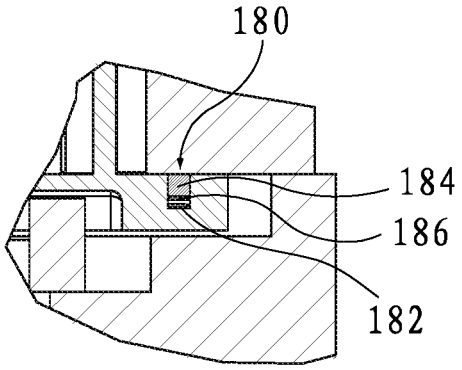
Figure 3C:
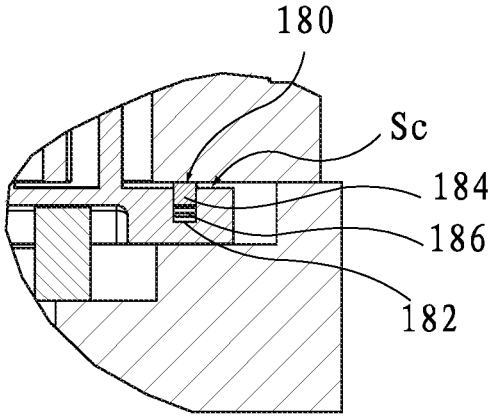

In this embodiment, an additional first sealing means 180 is provided to isolate the back pressure chamber B from the compression chamber. As shown in FIGS. 3A, 3B and 3C, the first sealing means 180 is displaceable in the axial direction to accommodate axial floating and overturning of the orbiting scroll member 30. The sealing means 180 is embedded in a circumferential groove 182 (as a first circumferential groove) in the orbiting scroll member end plate 34 and includes, for example, an O-shaped sealing ring 184 (as a first sealing member) and a compression spring 186 (as a first elastic element), and the sealing ring 184 abuts against the peripheral wall portion 22 of the non-orbiting scroll member under the action of the compression spring 186.

During the operation of the scroll compressor, as shown in FIG. 3B, the communication passage 35 in the orbiting scroll member end plate 34 introduces the pressure in one of the compression chambers (e.g., the intermediate pressure chamber C2) into the back pressure chamber B to accumulate a back pressure to allow the orbiting scroll member 30 to be closed with the non-orbiting scroll member 20, that is, the orbiting scroll member end plate 34 is hermetically engaged with the peripheral wall portion 22 of the non-orbiting scroll member at the compression chamber seal portions Sc. Moreover, the sealing ring 184 is imbedded into the circumferential groove 182, such that the wear of the sealing ring 184 when the orbiting scroll member 30 makes translational revolution can be reduced.

When the orbiting scroll member 30 is separated from the non-orbiting scroll member 20 in the case that the compressor is stopped or abnormal, the orbiting scroll member end plate 34 and the non-orbiting scroll member end plate 32 are separated at the compression chamber seal portions Sc, referring to FIG. 3C. With the separation at the seal portions Sc, the compression chambers C1, C2, and C3 are communicated via axial gaps between the vanes and the end plates of the orbiting scroll member and the non-orbiting scroll member, and the pressures in the compression chambers are released through the fluid inlet fitting 17. At the same time, the compression spring 186 pushes out the sealing ring 184 to maintain the sealing ring 184 to abut against the non-orbiting scroll member end plate 24, i.e. the first sealing means 180 maintains sealing. The seal is maintained by the first sealing means 180, thus, the pressure in the back pressure chamber B can be substantially maintained without being leaked to the compression chambers and released together with the pressures in the compression chambers. When the compression mechanism needs to be engaged again in this case, the pressure in the back pressure chamber B can quickly move the orbiting scroll member 30 towards the non-orbiting scroll member 20 and form a seal at the seal portions Sc.

In addition, when the compressor is cold-started after normal shutdown, the first sealing means 180 can increase the pressure build-up speed in the back pressure chamber B, thereby facilitating the speedup of starting of the compressor.

It can be seen that by providing the first sealing means 180, the back pressure chamber B can be always separated from the compression chamber. Since there is no need to avoid leakage at the compression chamber seal portions Sc, there is no particular requirement for the floating amount of the orbiting scroll member 30, and the floating amount can be designed to be large, thus, the accuracy requirements of the orbiting scroll member 30, the non-orbiting scroll member 20 and the main bearing housing 50 can be reduced, thereby reducing the cost. In addition, since the floating amount is large, the compression chamber can be quickly depressurized, and since the movable range of the orbiting scroll member 30 is large, the orbiting scroll member 30 is easy to return to the position for engagement with the non-orbiting scroll member 20 after being overturned without being stuck.

Figure 4:
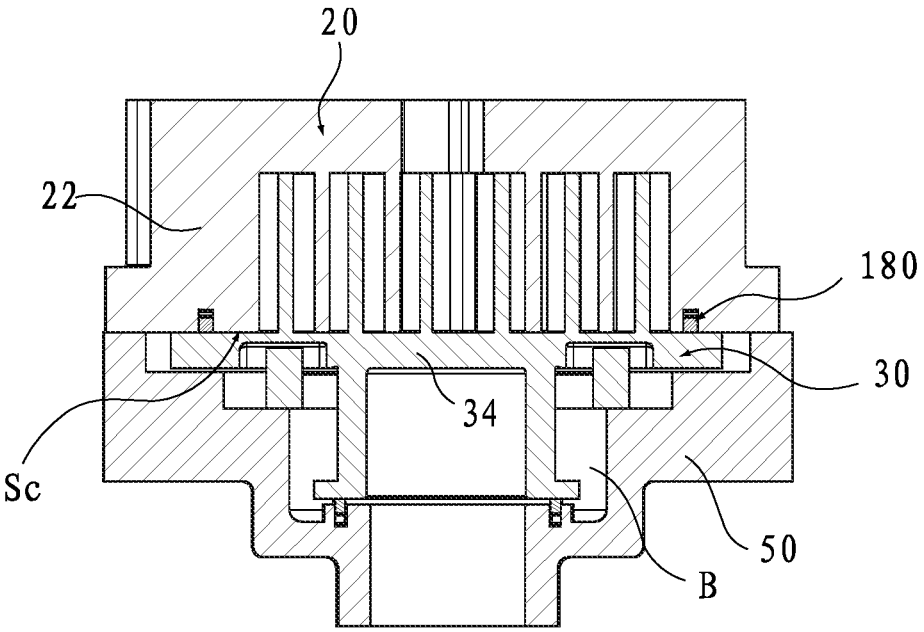
FIGS. 4 to 9 show partial sectional views of variations of the scroll compressor according to the first embodiment of the present application.
Figure 5:
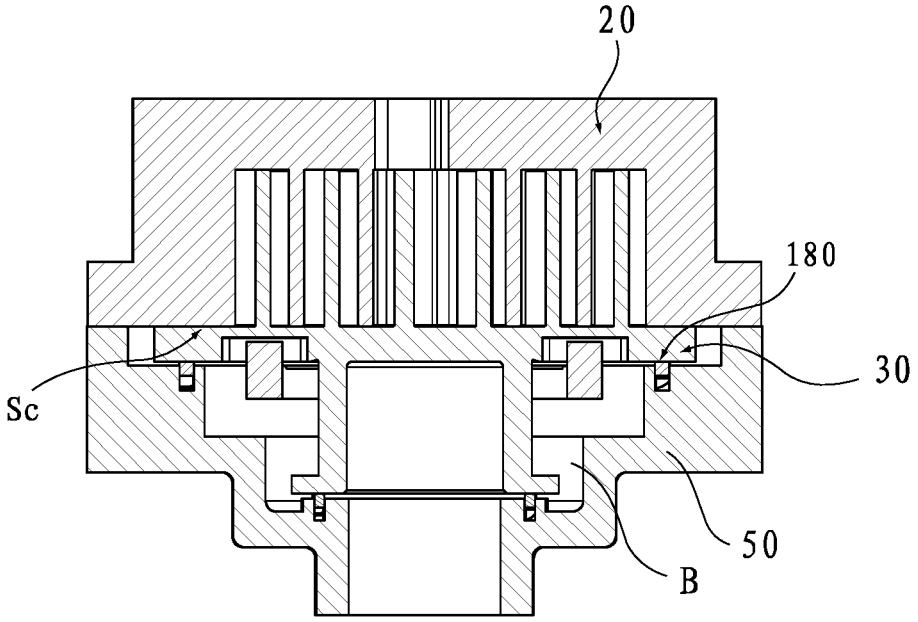

Although in the first embodiment of the high side scroll compressor described above, the first sealing means 180 is arranged in the circumferential groove 182 in the orbiting scroll member 30 and faces the non-orbiting scroll member 20, it should be appreciated by the person skilled in the art that, as shown in FIG. 4, the first sealing means 180 may also be arranged in a circumferential groove located in the non-orbiting scroll member 20 (e.g., the peripheral wall portion 22 of the non-orbiting scroll member) and face the orbiting-scroll member 30 (the orbiting scroll member end plate 34). Alternatively, the first sealing means 180 may be provided at opposite surfaces between the orbiting scroll member 30 and the main bearing housing 50, for example, provided on the main bearing housing 50, as shown in FIG. 5. In a case shown in FIG. 5, the radially outer side of the back pressure chamber B is defined by the sealing ring 184 of the first sealing means 180. That is, the first sealing means 180 forms a sealing surface for isolating the back pressure chamber B from the compression chamber, and the sealing surface forming the compression chamber is still provided by the compression chamber seal portions Sc. Although not shown, it is also contemplated that the first sealing means 180 may also be provided on the main bearing housing 50 and face the orbiting scroll member 32. These variations are capable of achieving the same technical effects as those of the above first sealing means 180, and will not be described here further.

Figure 3D:
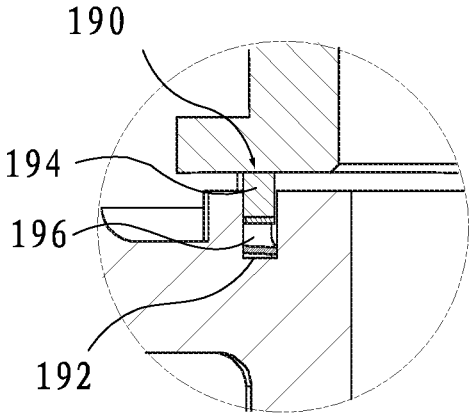
FIG. 3D shows an enlarged view of a portion P2 in FIG. 3A.

In addition, in the first embodiment, as shown in FIGS. 3A and 3D, at least a part (shown as an axial end face) of the hub 32 of the orbiting scroll member 30 is directly hermetically engaged with a second part 54 of the main bearing housing 50 by a second sealing means 190.

The second sealing means 190 is provided in a circumferential groove 192 (a second circumferential groove) located in one of an axial end face of the hub 32 and the main bearing housing 50 (shown as being provided in the main bearing housing 50), to isolate the back pressure chamber B from an external high pressure environment. Referring to FIG. 3D, the second sealing means 190 includes a compression spring 196 (a second elastic element) supported by the circumferential groove 192 and an O-shaped sealing ring 194 (a second sealing member) supported by the compression spring 196. The sealing ring 194 abuts against the other of the hub 32 and the main bearing housing 50 (shown as abutting against the hub 32) under the action of the compression spring 196. The second sealing means 190 can be displaced or deformed (hereinafter collectively referred to as displacement) in the axial direction to allow axial floating of the orbiting scroll member 30, i.e., to maintain sealing when the orbiting scroll member 30 is displaced.

In the above description, though for each of the first sealing means 180 and the second sealing means 190, an O-shaped sealing ring is used as the sealing member and a compression spring is used as the elastic element, it is to be appreciated that sealing members of other shapes and elastic elements of other forms which are conceivable by the person skilled in the art may also be used. Alternatively, the sealing member and the elastic element may be an integral elastic sealing member that is compressed when the orbiting scroll member is in the engaged position and automatically extends to achieve sealing when the orbiting scroll member is in the disengaged position.

Figure 6:
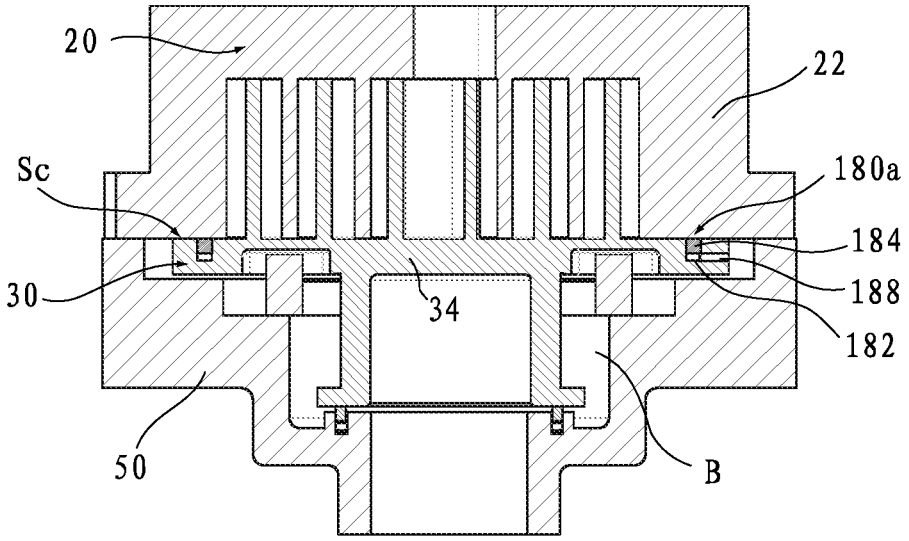

The first sealing means may also have other variations. As one of the variations, as shown in FIG. 6, a first sealing means 180*a* is imbedded in the circumferential groove 182 of the orbiting scroll member end plate 34 and faces the peripheral wall portion 22 of the non-orbiting scroll member. The sealing means 180*a* also includes an O-shaped sealing ring 184, but unlike the sealing means 180, the sealing means 180*a* does not include a compression spring 186 but includes a passage 188 extending from the back pressure chamber B into the circumferential groove 182.

As described above, when the compressor is stopped or abnormal or the like, the orbiting scroll member 30 is separated from the non-orbiting scroll member 20 (the seal portions Sc are separated), and the pressures in the compression chambers C1, C2, and C3 are uniformed due to communication of the compression chambers C1, C2, and C3, and are released. In this case, the pressure in the back pressure chamber B may be higher than the pressure in the compression chambers. Therefore, the pressure in the back pressure chamber B is introduced into the circumferential groove 182 through the passage 188 and acts on a bottom surface of the sealing ring 184. The sealing ring 184 is pushed out toward the non-orbiting scroll member 20 (specifically, the peripheral wall portion 22) so that the sealing ring 184 abuts against the peripheral wall portion 22 of the non-orbiting scroll member so as to keep the first sealing means 180 sealing. The seal of the first sealing means 180*a* can substantially maintain the pressure in the back pressure chamber B without leaking the pressure to the compression chambers and without releasing the pressure together with the pressures in the compression chambers. Thus, the first sealing means 180*a* also provides a sealing surface independent of the compression chamber seal portions Sc so that the pressure relief in the compression chambers will not affect the pressure in the back pressure chamber B, thereby achieving the same effect as that can be achieved by the above first sealing means 180. In addition, by using the passage 188 to replace the spring 186, it is possible to save the cost and improve the operational reliability of the sealing means 180*a* by replacing the provision of the spring member by machining.

Figure 7:
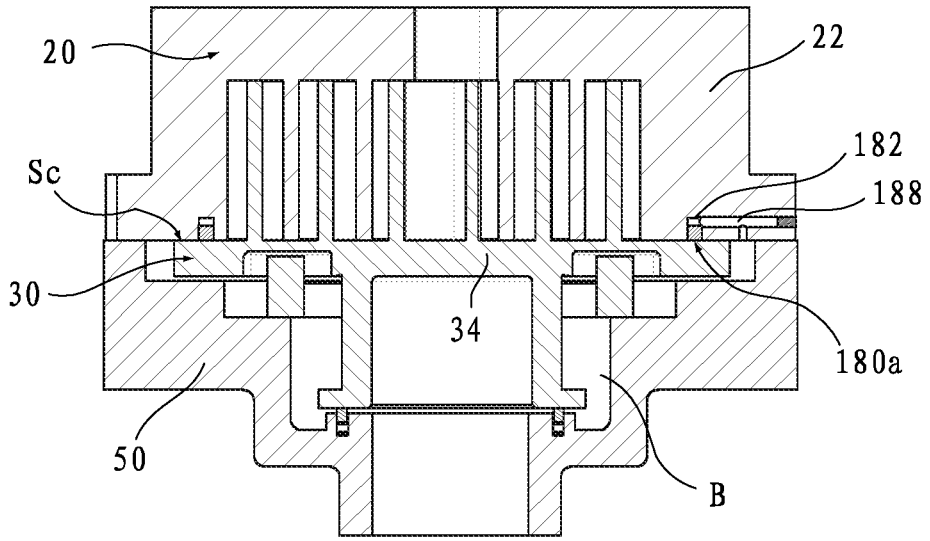
Figure 8:
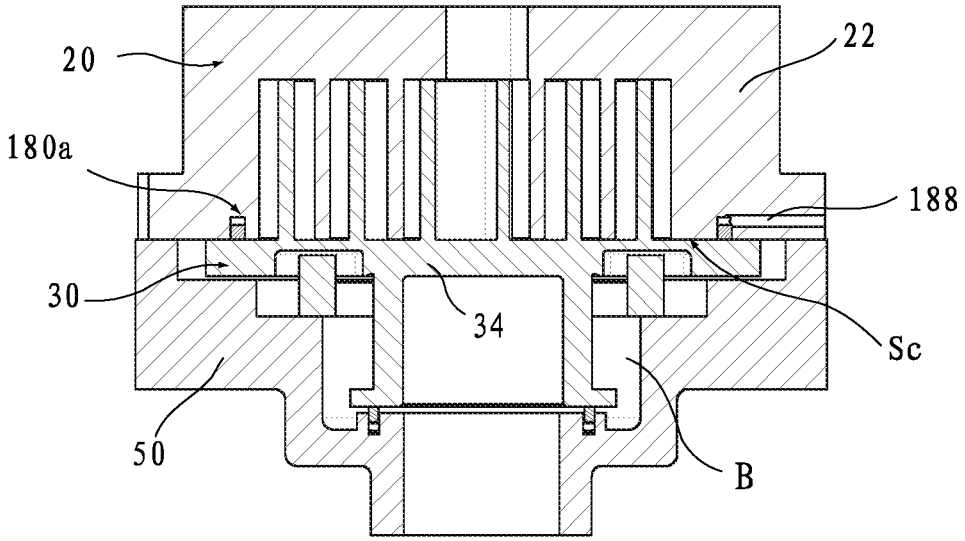

The first sealing means 180*a* may also be provided on the non-orbiting scroll member 20 and face the orbiting scroll member 30, as shown in FIG. 7. The first sealing means 180*a* also introduces the pressure of the back pressure chamber B into the circumferential groove 182 through the passage 188. In addition, since the scroll compressor is a high side compressor and the compression mechanism CM is in a high pressure environment as a whole, the passage 188 of the first sealing means 180*a* may be provided as being in communication with a high pressure environment outside of the compression mechanism CM, as shown in FIG. 8. In each of these cases, the first sealing means 180*a* forms a sealing surface for isolating the back pressure chamber B from the compression chambers, and the sealing surface forming the compression chambers is still provided by the compression chamber seal portions Sc. As can be appreciated from the above examples, the passage 188 may be implemented in a variety of forms as long as it introduces a pressure higher than the pressure in the back pressure chamber B into the circumferential groove 182.

Figure 9:
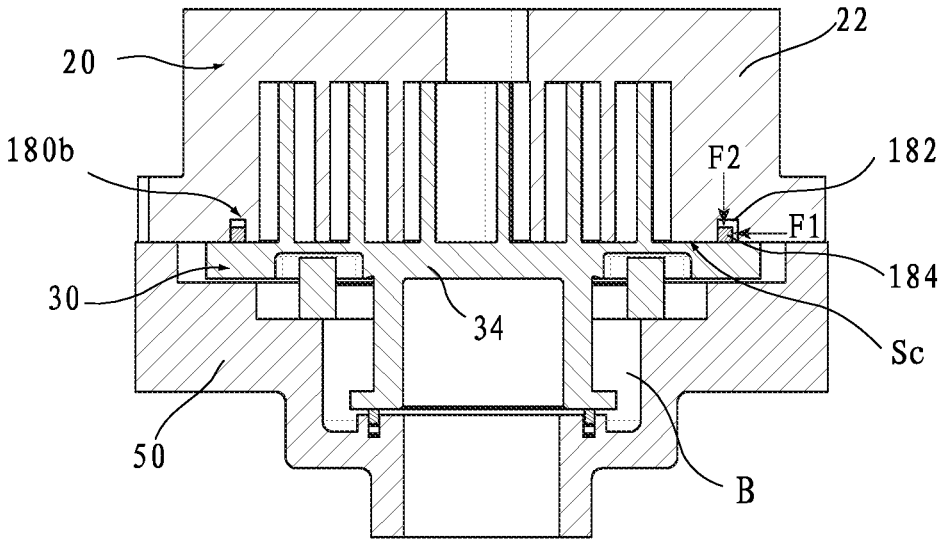

As a further variation of the first sealing means, as shown in FIG. 9, a first sealing means 180*b* includes only the O-shaped sealing ring 184 provided in the circumferential groove 182. The radial and axial dimensions of the circumferential groove 182 are greater than the radial and axial dimensions of the sealing ring 184 respectively to allow the sealing ring 184 to be movable in the circumferential groove 182.

In the process of operation of the compressor, the non-orbiting scroll member 20 and the orbiting scroll member 30 are closely fitted against each other at the seal portions Sc, and the sealing ring 184 is freely retracted into the circumferential groove 182 to avoid wear. When there is an abnormality or the orbiting scroll member 30 is in the disengaged position, since at a radially inner side of the sealing ring 184 of the first sealing means 180*b* is the suction pressure zone, at a radially outer side thereof is the back pressure zone B, and the pressure in the back pressure zone B is higher than the pressure in the suction pressure zone, the sealing ring 184 is pressed against the side wall of the circumferential groove 182 (referring to F1). In addition, the pressure in the back pressure zone B can be transmitted to a back surface of the sealing ring 184, to press the sealing ring 184 against the orbiting scroll member 30 (referring to F2). That is, when the non-orbiting scroll member 20 and the orbiting scroll member 30 are separated, the first sealing means 180*b* maintains sealing.

Accordingly, all of these variations are capable of achieving the same technical effects as those achieved by the above first sealing means 180, and those technical effects will not be described again.

Figure 10C:
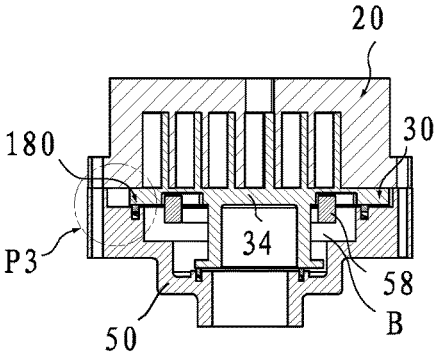
FIGS. 10A-10H show comparison of cases of a single scroll with cases of a twin scroll.
Figure 10D:
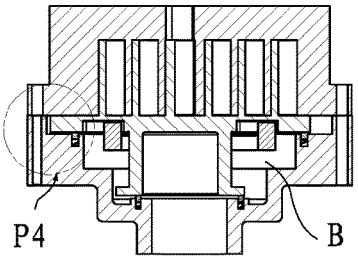
Figure 10A:
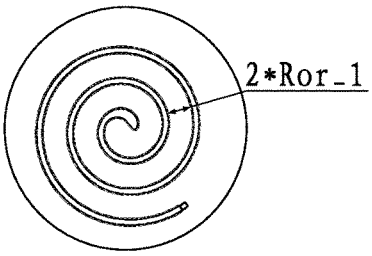
Figure 10E:
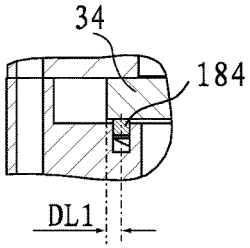
Figure 10F:
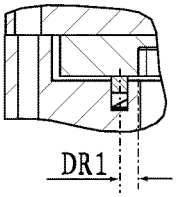
Figure 10B:
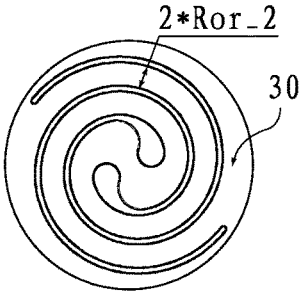

Preferably, the orbiting scroll member 30 and the non-orbiting scroll member 20 of the scroll compressor are not in the form of a single scroll (referring to FIG. 10A), but in the form of a twin scroll (referring to FIG. 10B). Only an example of the orbiting scroll member 30 is shown in FIG. 10B, and the person skilled in the art can appreciate that the non-orbiting scroll member 20 has a matching vane shape.

During the operation of the compression mechanism CM, the central axis of the orbiting scroll member rotates around the central axis of the non-orbiting scroll member with a radius of revolution Ror. It is required that the sealing ring 184 cannot be exposed from a peripheral edge of the orbiting scroll member end plate 34 when the orbiting scroll member is moved to a rightmost position (referring to FIG. 10C), and the sealing ring 184 cannot enter a sliding groove 33 configured to accommodate the Oldham coupling 58 when the orbiting scroll member is moved to a leftmost position (referring to FIG. 10D).

For a single scroll with a radius of revolution Ror_1, when the orbiting scroll member is moved to the rightmost position, referring to FIG. 10E, the sealing ring can be adjusted by the distance of DL1 from the current position to the left, that is, the sealing ring can be arranged at any position within the range DL1, and the sealing ring will not be exposed from the peripheral edge of the orbiting scroll member. When the orbiting scroll member is moved to the leftmost position, referring to FIG. 10F, the sealing ring can be adjusted by the distance of DR1 from the current position to the right, that is, the sealing ring can be arranged at any position within the range DR1, and the sealing ring will not enter the sliding groove 33.

Figure 10G:
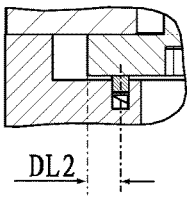
Figure 10H:
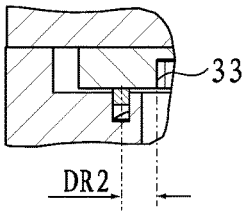

For a twin scroll with a radius of revolution Ror_2, when the orbiting scroll member is moved to the rightmost position, referring to FIG. 10Q the sealing ring 184 can be adjusted by the distance of DL2 from the current position to the left, that is, the sealing ring 184 can be arranged at any position within the range DL2, and the sealing ring 184 will not be exposed from the peripheral edge of the orbiting scroll member. When the orbiting scroll member is moved to the leftmost position, referring to FIG. 10H, the sealing ring 184 can be adjusted by the distance of DR2 from the current position to the right, that is, the sealing ring 184 can be arranged at any position within the range DR2, and the sealing ring 184 will not enter the sliding groove 33.

In the case that an unfolding angles of the generating lines are equal, the radius of revolution Ror_2 of the twin scroll is about a half of the radius of revolution Ror_1 of the single scroll. Therefore, the range of revolution of the orbiting scroll member 30 is small compared with that in a case of a single scroll, which enables the range for setting the sealing ring (i.e., the adjustment range of the sealing ring) to become larger. It can be seen from the comparisons of FIG. 10E with FIG. 10G, and FIG. 10F with FIG. 10H that the leftward adjustment ranges of the sealing ring: DL2>DL1 and the rightward adjustment ranges of the sealing ring: DR2>DR1.

The position of the sealing ring 184 can affect the area, for applying pressure to the orbiting scroll member 30, of the back pressure zone B, therefore, by increasing the adjustment range of the sealing ring, it is possible to facilitate the design of the force applying area of the back pressure zone, and thereby, the axial force of the scroll set can be further optimized. In addition, increasing the adjustment range of the sealing ring can correspondingly reduce the dimension of the end plate of the orbiting scroll member, making the design more suitable for the case where the structure is relatively compact.

Figure 11:
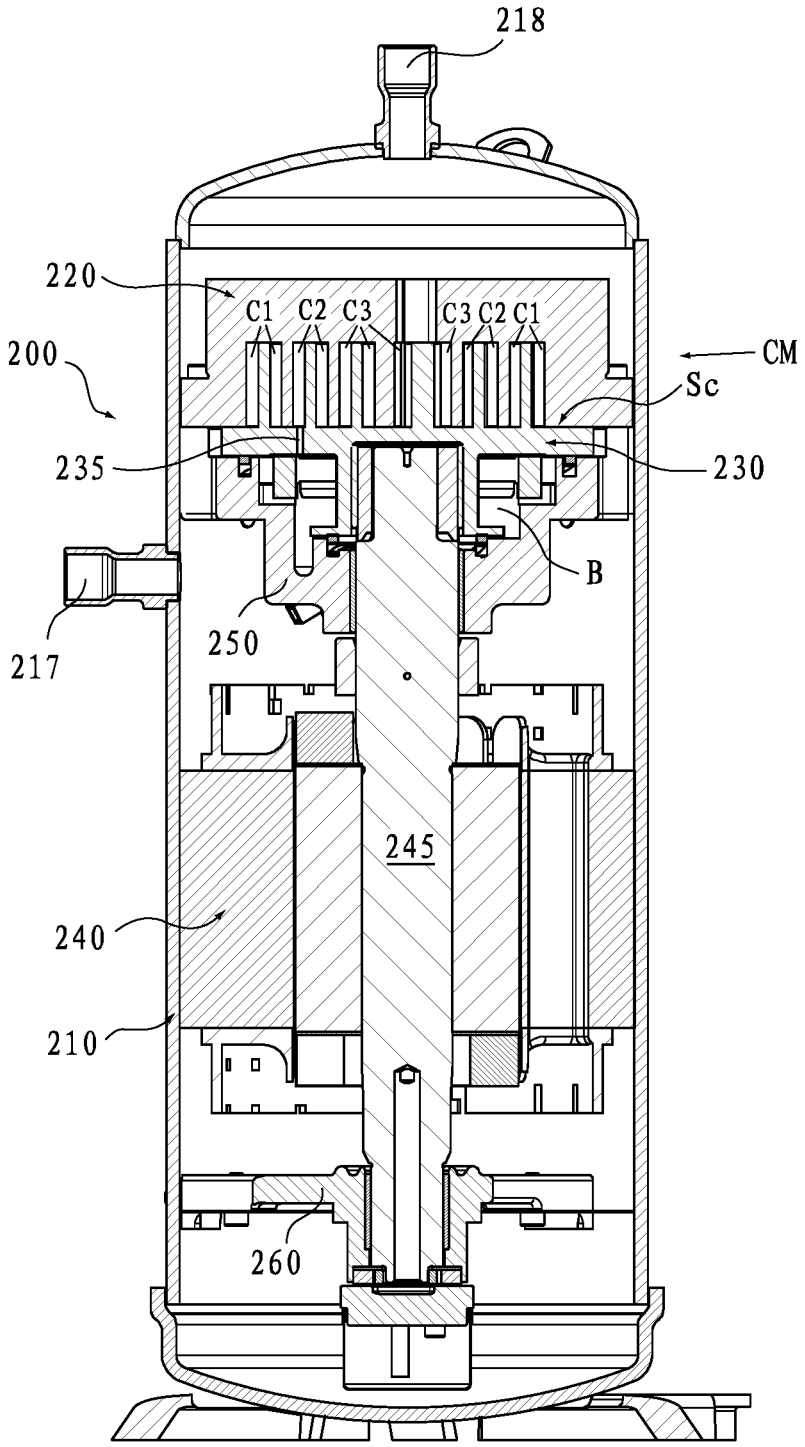
FIG. 11 shows an axial sectional view of a scroll compressor according to a second embodiment of the present application.

A scroll compressor 200 according to a second embodiment of the present application is described hereinafter with reference to FIGS. 11 and 12. Unlike the first to fourth embodiments described above, the scroll compressor 200 is a low side compressor, that is, the compression mechanism CM is in the suction pressure zone, i.e., a low pressure zone.

The scroll compressor 200 includes a substantially closed housing 210, and a non-orbiting scroll member 220 of the compression mechanism CM is hermetically engaged with the housing to divide an internal space of the housing 210 into a low pressure side and a high pressure side. A drive mechanism 240, which drives the compression mechanism CM by a drive shaft 245 (which is supported by a main bearing housing 250 and a lower bearing housing 260), is arranged in the low pressure side, i.e., under the suction pressure. It will be appreciated by the person skilled in the art that the drive mechanism 240 may also be provided at the outside of the housing 210 for a so-called open compressor design. The housing 210 may be provided with a fluid inlet fitting 217 for intake of the working fluid and a fluid outlet fitting 218 for discharging the compressed working fluid.

The compression mechanism CM of the scroll compressor 200 has a structure substantially the same as that of the compression mechanism CM of the scroll compressor and includes an orbiting scroll member 230 and the non-orbiting scroll member 220. That is, the compression mechanism CM of the scroll compressor according to the first embodiment of the present application can be applied to a low side compressor.

In the scroll compressor 200, a substantially airtight back pressure chamber B is provided in a space inside the main bearing housing 250 on the orbiting scroll member 230 side. The back pressure chamber B is defined by the orbiting scroll member 230, the non-orbiting scroll member 220 and the main bearing housing 250 together. The back pressure chamber B is in communication with a compression chamber (e.g., the intermediate pressure chamber C2) via a communication passage 235 formed in an orbiting scroll member end plate 234, thereby accumulating a back pressure in the back pressure chamber B. It is to be appreciated that the communication passageway 235 may also be provided in the non-orbiting scroll member 220.

The non-orbiting scroll member 220 is also axially hermetically engaged with the orbiting scroll member 230 at the compression chamber seal portions Sc, which will not be described again.

Figure 12:
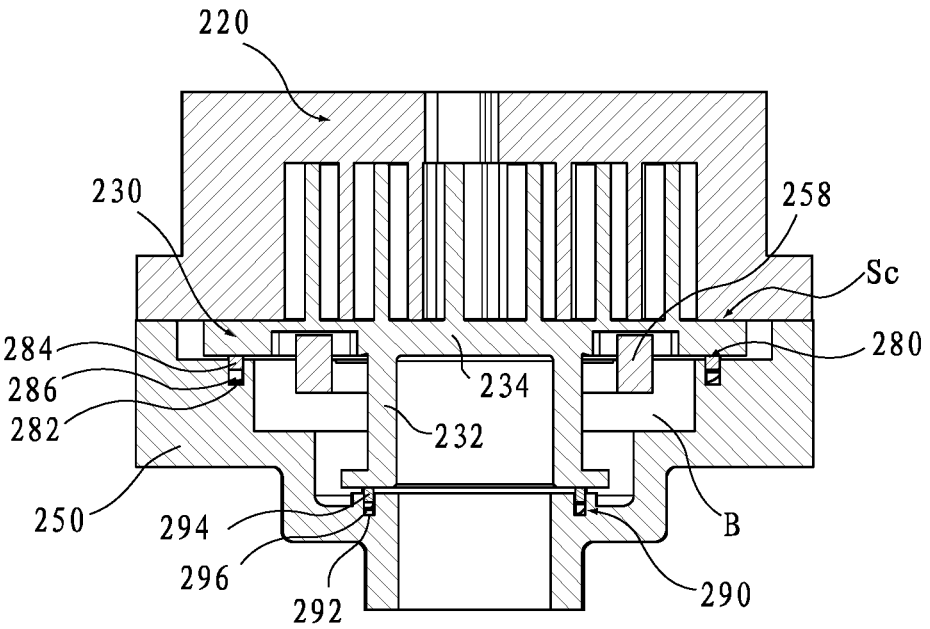
FIG. 12 shows a partial sectional view of a scroll compressor according to a second embodiment of the present application.

Referring to FIG. 12, in the scroll compressor 200, a second sealing means 290, which is the same as that in the first embodiment, is provided at surfaces where the main bearing housing 250 faces a hub 232 of the orbiting scroll member 230. The second sealing means 290 isolates the back pressure chamber B from an external low pressure environment. The second sealing means 290 is axially displaceable to allow axial floating of the orbiting scroll member 230. The sealing means 290 may have a structure similar to that of the sealing means 190. For example, the sealing means 290 is arranged in a circumferential groove 292 (a second circumferential groove) located in one of an axial end face of the hub 232 of the orbiting scroll member and the main bearing housing 250, and includes an O-shaped sealing ring 294 (a second sealing ring) and a compression spring 296 (a second elastic element). The sealing ring 294 abuts against the other of the axial end face of the hub 232 of the orbiting scroll member and the main bearing housing 250 under the action of the compression spring 296.

In some conventional designs of the low side compressor, the second sealing means is not arranged at the axial end face of the hub of the orbiting scroll member but is arranged at substantially the same axial position as the Oldham coupling between the orbiting scroll member and the main bearing housing, for example, arranged opposite surfaces of the orbiting scroll member end plate and the main bearing housing. In this case, the first sealing means, the second sealing means and the Oldham coupling are located at substantially the same axial position, making it difficult to adjust the position of these components, and it is often necessary to design the dimension of the orbiting scroll member end plate large to provide the space for arranging these components.

In this embodiment, the Oldham coupling can be adjusted within a large space by arranging the second sealing means 290 to be offset from the first sealing means 280 and the Oldham coupling 258 in the axial direction. For example, the Oldham coupling may be arranged in a radially inner side of the first sealing means 280 (will be described below), and in this case, the Oldham coupling has a relatively small mass and a better dynamic balance. The Oldham coupling may also be arranged in a radially outer side of the first sealing means 280, and in this case, the distance between keys is increased, the force subjected by the keys is reduced, the wear of the keys and corresponding key grooves is reduced, and the service life thereof is improved. The arrangement position can be chosen flexibly based on practical applications.

In addition, by arranging the second sealing means 290 at the axial end face of the hub 232 of the orbiting scroll member 230, the second sealing means 290 can be made small to facilitate expansion of the back pressure chamber area, optimizing the axial force and improving performance of the compressor.

In addition, the dimension of the main bearing housing 250 may affect only the dimension of the second sealing means 290, but has little effect on the Oldham coupling 258 and the first sealing means 280, causing the wide adaptability of the solution.

It should be appreciated that the second sealing means 190 may also be arranged between the main bearing housing 250 and other portions of the orbiting scroll member 230 as long as the second sealing means is not in the same axial position as at least one of the first sealing means 280 and the Oldham coupling.

As shown in FIG. 12, a first sealing means 280, which is the same as that in the first embodiment, is provided between the orbiting scroll member 230 and the main bearing housing 250, and the first sealing means 280 is axially displaceable to accommodate axial floating and overturning of the orbiting scroll member 230. The first sealing means 280 is imbedded in a circumferential groove 282 (a first circumferential groove) in the main bearing housing 250 and includes, for example, an O-shaped sealing ring 284 (a first sealing member) and a compression spring 286 (a first elastic element). The sealing ring 284 abuts against the orbiting scroll member end plate 234 under the action of the compression spring 286.

It can be seen that by providing the first sealing means 280, the back pressure chamber B can be always separated from the compression chambers. Since it is not necessary to avoid the leakage at the compression chamber seal portions Sc, it is possible to realize the advantages described above in connection with the scroll compressor according to the first embodiment.

Figure 13:
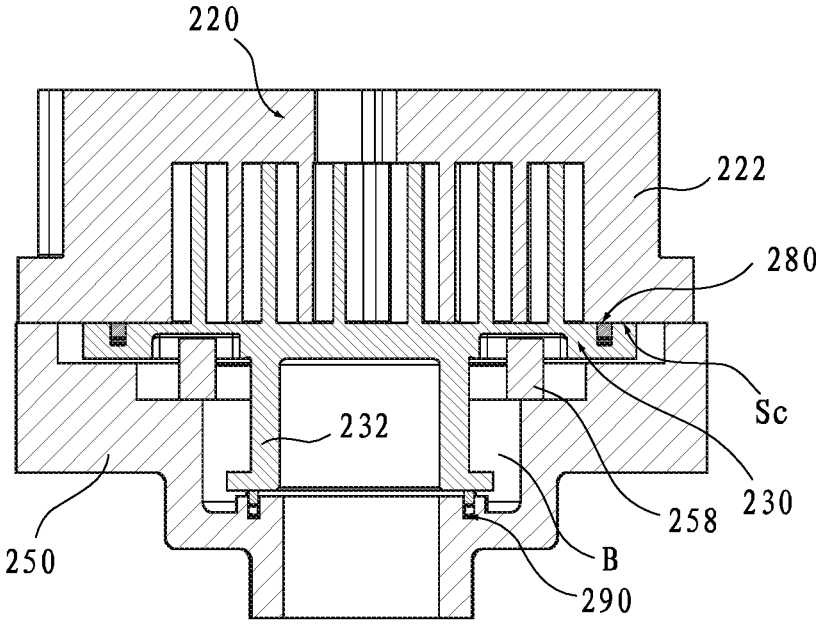
FIG. 13 shows a partial sectional view of a variation of a scroll compressor according to a second embodiment of the present application.

Similar to the case in the first embodiment, the position of the first sealing means 180 in the second embodiment can also be changed. As shown in FIG. 13, the first sealing means 180 is provided in the circumferential groove 282 in the orbiting scroll member end plate 234, and abuts against the peripheral wall portion 222 of the non-orbiting scroll member 220. With this arrangement, the second sealing means 290 and the first sealing means 280 may both have a larger space for adjustment, thus facilitating the optimization of the axial force.

In addition, the first sealing means 280, the second sealing means 290, and the Oldham coupling 258 are misaligned in the axial direction, i.e., are not located in the same axial position. In this way, the design of the Oldham coupling 258 will no longer be limited by the location and dimension of the sealing means, and its adjustment space is greater, thus facilitating further optimization of the structure.

While the present application has been described above in connection with various embodiments of the present application, it should be appreciated that, in the case of compatibility, the technical features described in connection with one embodiment can be combined with the technical features described in connection with other embodiments. For example, all the following features: the first sealing means arranged on the orbiting scroll member, the non-orbiting scroll member or the main bearing housing; the first sealing means and the second sealing means employing a compression spring, a passage for introducing a gas pressure, or independent sealing members (the two sealing means can have different structures) controlled by only the pressure in the back pressure chamber; the pressure introduced from the back pressure zone or an external high pressure zone; a twin scroll employed; the compression mechanism arranged in the high pressure side or the low pressure side, etc., can be combined arbitrarily, and all the combinations are within the scope of the present application.

While the various embodiments of the present application have been described in detail herein, it is to be appreciated that the present application is not limited to the specific embodiments described and illustrated herein in detail, and other variations and modifications can be implemented by the person skilled in the art without departing from the essential and scope of the present application. All the variations and modifications are within the scope of the present application. Moreover, all of the components described herein may be replaced by other technically equivalent components.

The invention claimed is:

1. A scroll compressor, comprising:

a compression mechanism comprising a non-orbiting scroll member and an orbiting scroll member, the orbiting scroll member being axially displaceable between an engagement position and a disengagement position, the orbiting scroll member and the non-orbiting scroll member being axially engaged to form a series of compression chambers for compressing fluid in the engagement position, and the orbiting scroll member and the non-orbiting scroll member being axially disengaged in the disengagement position;

a main bearing housing supporting the compression mechanism;

a back pressure chamber formed between the orbiting scroll member and the main bearing housing, the back pressure chamber being in communication with at least one of the compression chambers via a communication passage and applying a back pressure to the orbiting scroll member to bias the orbiting scroll member toward the engagement position;

a first seal provided between the back pressure chamber and a suction zone of the compression mechanism, the first seal isolating the back pressure chamber from a suction chamber of the compression chambers, the first seal being arranged in a first circumferential groove, the first circumferential groove being located in one of the orbiting scroll member and the non-orbiting scroll member, and the first seal abutting the other of the orbiting scroll member and the non-orbiting scroll member; and a second seal arranged in a second circumferential groove, the second circumferential groove being located in one of an axial end face of a hub of the orbiting scroll member and the main bearing housing, the second seal abutting the other of the axial end face of the hub and the main bearing housing, and the second seal isolating the back pressure chamber from a space in the hub of the orbiting scroll member.

2. The scroll compressor according to claim 1, wherein the first seal includes a first sealing member arranged in the first circumferential groove.

3. The scroll compressor according to claim 2, wherein the first seal includes a first elastic element located between the first sealing member and the first circumferential groove, and the first elastic element applies a biasing force to the first sealing member.

4. The scroll compressor according to claim 2, wherein a radial dimension of the first sealing member is smaller than a radial dimension of the first circumferential groove.

5. The scroll compressor according to claim 2, wherein the first seal includes a first passage, and the first passage introduces a pressure higher than a suction pressure of the compression mechanism into the first circumferential groove to apply a biasing force to a bottom surface of the first sealing member.

6. The scroll compressor according to claim 5, wherein the scroll compressor is a low side compressor, and the first passage introduces a pressure in the back pressure zone into the first circumferential groove.

7. The scroll compressor according to claim 5, wherein the scroll compressor is a high side compressor, and the first passage introduces the pressure in the back pressure zone or the pressure in an external environment of the compression mechanism into the first circumferential groove.

8. The scroll compressor according to claim 1, wherein the second seal incudes a second sealing member arranged in the second circumferential groove and a second elastic element located between the second sealing member and the second circumferential groove, and the second elastic element applies a biasing force to the second sealing member.

9. The scroll compressor according to claim 1, wherein scroll vanes of the orbiting scroll member and the non-orbiting scroll member are in the form of a twin scroll.

* * * * *